US012752972B2

(12) United States Patent
Bois

(10) Patent No.: US 12,752,972 B2
(45) Date of Patent: Oct. 6, 2026

(54) CONTAINER WITH CAP AND LOCATOR AID

(71) Applicant: AIRNOV, INC., Wilmington, DE (US)

(72) Inventor: Dominique Bois, Montreuil aux Lions (FR)

(73) Assignee: AIRNOV, INC., Wilmington, DE (US)

( * ) Notice: Subject to any disclaimer, the term of this patent is extended or adjusted under 35 U.S.C. 154(b) by 0 days.

(21) Appl. No.: 18/923,850

(22) Filed: Oct. 23, 2024

(65) Prior Publication Data

US 2025/0042624 A1 Feb. 6, 2025

Related U.S. Application Data

(63) Continuation of application No. 17/262,138, filed as application No. PCT/EP2019/068238 on Jul. 8, 2019, now Pat. No. 12,151,855.

(51) Int. Cl.
*B65D 43/16* (2006.01)
*B65D 81/26* (2006.01)

(52) U.S. Cl.
CPC ..... *B65D 43/169* (2013.01); *B65D 81/266* (2013.01); *B65D 2543/00092* (2013.01); *B65D 2543/00518* (2013.01); *B65D 2543/00537* (2013.01); *B65D 2543/00555* (2013.01); *B65D 2543/00842* (2013.01)

(58) Field of Classification Search
CPC ..... B65D 43/169; B65D 2543/00518; B65D 81/266; B65D 2543/00092; B65D 2543/00537; B65D 2543/00555; B65D 2543/00842; B65D 45/00
USPC ..... 206/204
See application file for complete search history.

(56) References Cited

U.S. PATENT DOCUMENTS

2008/0067142 A1* 3/2008 Druitt ..... B65D 41/04 215/324
2014/0319162 A1* 10/2014 Bois ..... B65D 43/169 220/849

FOREIGN PATENT DOCUMENTS

WO WO-2013043219 A1 * 3/2013 ..... B65D 51/247
WO WO-2016135226 A1 * 9/2016 ..... B65D 43/0218

* cited by examiner

*Primary Examiner* — Rafael A Ortiz
(74) *Attorney, Agent, or Firm* — Scott R. Cox

(57) ABSTRACT

A container, preferably for loosely stored products, including a) a container body including a peripheral body wall;
b) a cover including an outer peripheral cover wall and a cover skirt;
c) a hinge connecting the container body and the cover, and
d) at least one protruding element provided on an peripheral body wall of the container and/or on an outer peripheral cover wall.

19 Claims, 7 Drawing Sheets

CONTAINER WITH CAP AND LOCATOR AID

CROSS-REFERENCE TO RELATED APPLICATIONS

This application is a continuation application claiming priority from U.S. application Ser. No. 17/262,138 filed Jan. 21, 2021 (which is currently pending), which was filed as a 371 US National Stage of International Application No. PCT/EP2019/068238, filed Jul. 8, 2019 which claims priority to European Patent Application No. 18184884.7, filed Jul. 23, 2018, the disclosures of which are herein incorporated by reference in their entirety. All publications, patents and patent applications referred to herein are incorporated by reference in their entirety.

FIELD OF INVENTION

The present invention relates to a container, preferably of the vial type and suitable for loosely stored products.

BACKGROUND OF THE INVENTION

In particular, the present invention relates to a container for receiving loosely stored products, such as drugs, pills, tablets, test strips, granulate and even powder. The container has a container body and a cover, preferably connected by a hinge. For such purposes the container has to be airtight in order to avoid a deterioration of the stored products even after the container has been opened and closed several times.

Containers of the above mentioned type are known and common to the skilled in the art. They usually comprise a cover that is integrally attached to the container, wherein the cover has a circular base with an outer periphery and a cylindrical tubular skirt extending perpendicularly and outwardly around the outer periphery of the base. Furthermore, such containers have also an upper portion and an inner and outer surface, wherein the container having a cylindrical upstanding rim at the upper portion, the rim is defined as that portion of the container that is sheltered by the cover when the container is in closed condition, and the rim having an inner and outer wall rim. Further, such covers comprise a thumb tab for facilitating the opening and closing of the container and at least one hinge attached to the container. The hinge has at least one hinge recess bend point that functions to rotate the cover at one pivot point. The thumb tab and the hinge are positioned on substantially opposing ends of the cover and extending, perpendicularly and outwardly from the skirt of the cover.

A flexible lip is often part of such containers, whereby the flexible lip is a projection that projects concentrically from an interior surface of the base of the cover. When the skirt of the cover overlies the container and at least a portion of the rim of the container engages the inner wall of the skirt of the cover, the flexible lip interacts with the rim to sufficiently deflect, so as to form a releasable seal between the cover and the container.

One of the main criteria of such containers is the air tightness in order to protect the stored products as good as possible. Improved demands in this respect require a very exact manufacturing of the containers particular the sealing portions.

Such containers may be transported via non-pressurized feeder aircraft or via ground over high mountain passes. In prior art containers the effects of the pressure difference generated by such modes of transport cannot always be guaranteed and undesired opening of the containers may occur.

Since such containers with hinged covers are intended to be opened and closed several times mainly by hand it is desired that the opening force of the container is well controlled such as the force required by a user to open the cover remains comfortable.

EP 2,207,727 discloses a container body and a cover, connected by a hinge. A flexible lip projects concentrically from an interior surface of the base of the cap.

The re-scalable container according to EP 2,966,000 B1 consists essentially of a container having a rim at its upper portion, and a cap having a circular base with an outer periphery, a cylindrical tubular skirt, the inner wall of which has at least one recess, and a hinge connecting the cap to the container. In a closed position, the skirt of cap overlies the container and the rim of the container is situated within the recess of the inner wall of the skirt of the cap.

Based on the explained disadvantages as well as by considering the explained prior art for containers of the above mentioned art, the aim of this invention is to provide a container of the above mentioned type, with excellent air tightness.

SUMMARY OF THE INVENTION

These and other objectives are solved by the object of the present invention. The container according to the invention is providing reduced moisture ingress and an improved holding of the cap closed onto the container body during shipment.

The present invention concerns a container as defined in independent claim 1. Embodiments of the invention are defined in the dependent claims.

DETAILED DESCRIPTION

The present invention and detailed embodiments of the present invention are disclosed herein, but it should be understood that the disclosed embodiments are merely exemplary of the invention, which may be embodied in various forms. The figures are not necessarily to scale; some features may be exaggerated to show details of particular components. Therefore, specific structural and functional details disclosed herein are not to be interpreted as limiting, but merely as a basis for the claims and as a representative basis for teaching one skilled in the art to variously employ the present invention.

In the present invention, the words vertical or horizontal relates to the vertical or horizontal direction when the container rests on its bottom.

DETAILED DESCRIPTION OF THE DRAWINGS

List of Reference Signs

Figure 1:
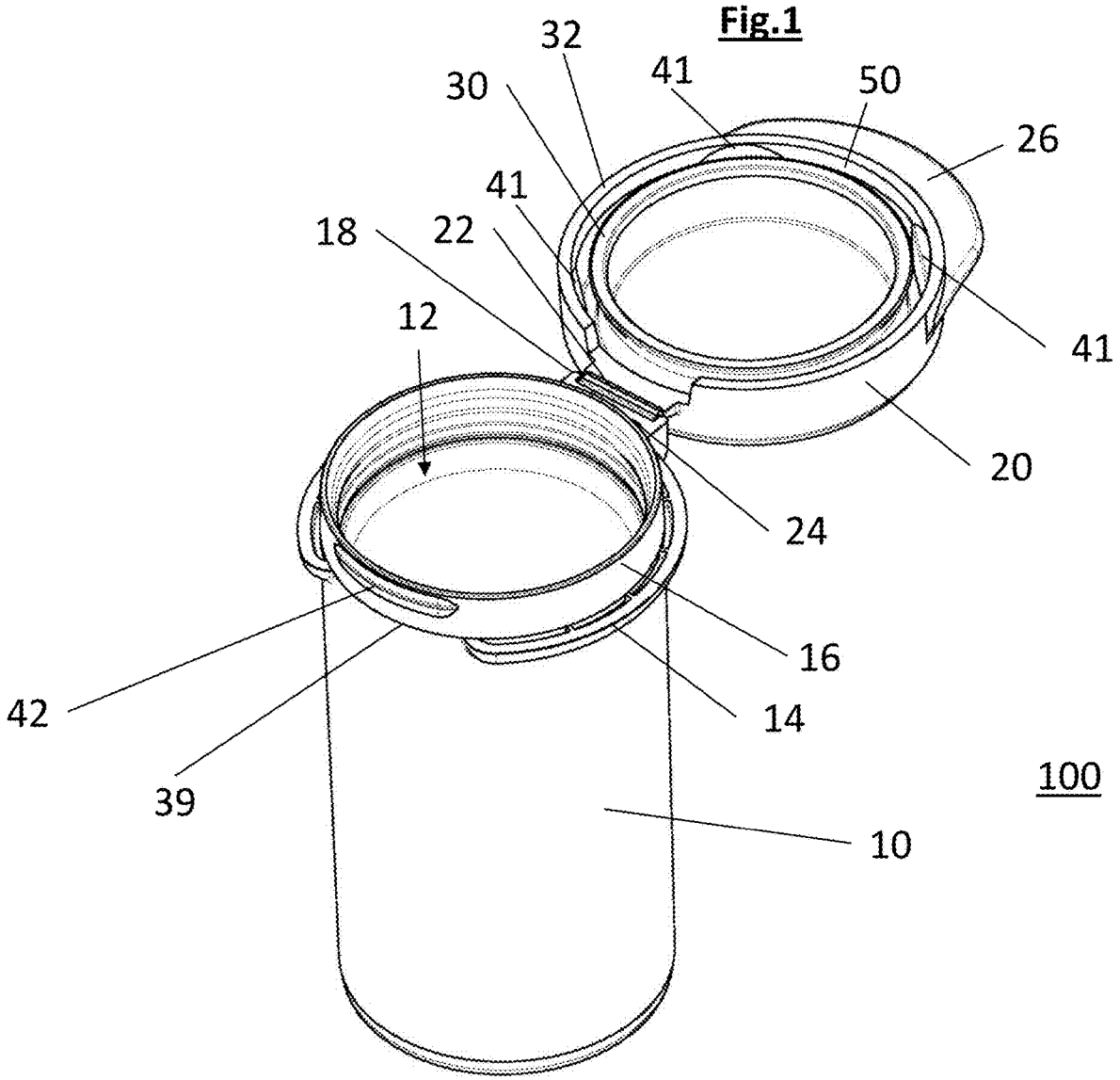
FIG. 1 shows the container 100 of the invention in perspective view in open state.

10 container body
11 insert
12 opening
13 peripheral body groove
14 bead
15 chamfer
16 peripheral body wall
17 bottom wall of the container body
18 first connecting means
18*a* web
18*b*, 18*c* side parts of the first connecting means
18*d* opening on the first connecting means
18*e*, 18*f* notches
19 gap
20 cover
21 projection
22 hinge
24 second connecting means
26 thumb tab
28 clearance
30 cover skirt
32 outer peripheral cover wall
34 sealing portion
36 apex
39 bead interruption
41 protruding element
42 protruding element
43 insert rib
44 locking rib
50 gap between the outer peripheral cover wall and the peripheral body wall when the cap is in a closed state
100 container The present invention concerns a container 100, preferably for loosely stored products.

The container 100 comprises a container body 10 comprising a peripheral body wall 16; a cover 20 comprising an outer peripheral cover wall 32 and a cover skirt 30; a hinge 22 connecting the container body 10 and the cover 20; and at least one protruding element 41, 42 provided on the peripheral body wall 16 of the container and/or on the outer peripheral cover wall 32. The protruding element(s) 41, 42 (or "protrusion(s)") act inter alia as a locator aid when closing the cover 20.

The protruding element limits a horizontal displacement of the cover, and in particular of the cover skirt, relative to the container body when the cover is in a substantially closed state. In other words, the protruding element allows a precise positioning of the cover onto the container body during its opening or closing and an optimized contact of the cover skirt against the container body, even when a lateral force is applied on the closed cover. Another advantage of the protruding element is that it allows a more precise adjustment of the opening forces, such that, in the same time, undesired opening of the container is prevented while force required by a user to open the cover remains comfortable.

The at least one protruding element does not form a locking element for mechanically holding the cover 20 in a closed state. In a one embodiment, the protruding element is free from any recess. In other words, it is substantially vertical or provided with a slight draft angle and it can be released from injection mould without forming an undercut needing force ejection. Alternatively, where a recess is created by a protruding element located on one of the peripheral body wall 16 of the container or the outer peripheral cover wall 32, there is no recess on the facing surface of the other of the peripheral body wall 16 of the container or the outer peripheral cover wall 32. Such, the recess formed by the protruding element does not interact with or contact a recess formed by another protruding element. The protruding element is not part of a catch and latch mechanism.

In a preferred embodiment, the at least one protruding element provided on the peripheral body wall 16 of the container and/or on the outer peripheral cover wall 32 interacts only with the facing side of the outer peripheral cover wall and/or of the peripheral body wall. It does not face, interact with or contact another protruding element, when the cap is in a closed state. In other words, when a protruding element is provided on one of the peripheral body wall 16 of the container or the outer peripheral cover wall 32, there is no protruding element provided on the facing surface of the other of the peripheral body wall 16 of the container or the outer peripheral cover wall 32.

The at least one protruding element 41, 42 provides a local reduction of the surrounding gap 50 existing between the peripheral body wall 16 of the container 100 and the outer peripheral cover wall 32.

The peripheral body wall 16 of the container 100 may comprise an inner peripheral body groove 13, and the cover skirt 30 may comprise an outwardly facing scaling portion 34 with an apex 36 that seals against the inner peripheral body groove 13 when the cover 20 is in a closed condition, thereby forming a seal of a sealing line type.

The apex 36 of the cover skirt 30 and the inner peripheral body groove 13 may provide the only seal between the cover 20 and the container body 10 when the container 100 is in the closed condition.

For such kind of container, the presence of at least one protruding element 41, 42 is particularly advantageous. It has been found that in absence of the at least one protruding element 41, 42, the cover may move towards the hinge when force is applied to the thumb tab. As a result, the dimensional interference between the apex 36 and the inner peripheral groove 13 reduces, and less force is required to open the cover. This can lead to inadvertent opening, e.g. during shipment of the container, and may lead to damages in the goods stored in the container.

The provision of at least one protrusion is avoiding or substantially reducing the translation of the cover relative to the container body, in particular during its opening motion. The opening force is more reliably controlled by the elastic properties of the cover skirt and by the depth of the peripheral body groove 13 and is less affected by variations in dimensional tolerances of all these surfaces as inevitably occurring in mass manufacturing.

Preferably, the container comprises at least two, more preferably at least three, protruding elements 41, 42 provided on the peripheral body wall 16 of the container and/or on the outer peripheral cover wall 32. The at least two protruding elements are angularly spaced from each other when the cover is in a closed state. In other words, they do not interact with each other or do not face each other.

Preferably, the protruding elements are distributed all around the periphery of the cover wall. Optionally the annular segment between the protruding elements is kept substantially even.

The series of protruding elements can be formed by a cord joining two points located on the inner surface of the outer peripheral cover wall. Alternatively, the series of protruding elements can be formed by vertical ribs extending substantially perpendicularly from the inner surface of the top wall of the cover.

Preferably, the protruding elements located on the inner surface of the outer peripheral cover wall are designed to avoid any moulding undercut. In a vertical section cut through the protruding element, no recess is created on the surface of the protruding element facing the rim of the container body. More preferably, the surface of the protruding element facing the rim of the container body is substantially vertical. Such, the protruding element can be released from cover's injection mould without being force ejected, increasing the dimensional precision of the protruding elements.

In an equivalent design alternative, the series of protruding elements can be provided on the external surface of container's peripheral body wall as a series of protrusion or a series of vertical rib.

In another embodiment, the series of protruding elements can be obtained from any combination of protruding elements located on cap's outer peripheral cover wall or body's peripheral body wall.

The at least one protrusion 41, 42 can be located on the outer side of the peripheral body wall 16 of the container 100 and/or on the inner side of the outer peripheral cover wall 32.

The at least one protrusion 41 can be located on the outer peripheral cover wall 32 and the at least one protrusion 42 can be located on the peripheral body wall 16 of the container (100).

The outer peripheral cover wall 32 of cover 20 of the container 100 may be situated radially outside of the cover skirt 30 and radially outside of the peripheral body wall 16.

The cover 20 may comprise a top wall from which the cover skirt 30 and the outer peripheral cover wall 32 extend. Preferably, the vertical distance of the apex 36 of the sealing portion 34 from the top wall is smaller than the vertical extension of the outer peripheral cover wall 32.

The peripheral body wall 16 has, when viewed from the top side, preferably rounded, for example oval or circular, surfaces. Rounded surfaces may be surfaces without sharp corners.

The container body 10 preferably has a cylindrical shape. A cylindrical shape is not only a circularly cylindrical shape but also a shape of a cylinder with a non-circular base. The container can generally have any shape.

The inner peripheral body groove 13 preferably has a depth of between 0.05 mm and 0.7 mm.

The skirt outer diameter of the cover skirt 30 at the position of the apex 36 preferably is greater than the peripheral body wall 16 inner diameter of the container body 10 at the position of the peripheral body groove 13. Preferably, the skirt outer diameter (da) and the peripheral body wall inner diameter (dg) satisfy the equation da=dg+x, where x is from 0.05 mm to 1.5 mm.

The peripheral body groove 13 preferably defines a groove radius in a cross section of the peripheral body wall 16 and the apex 36 of the sealing portion 34 defines an apex radius in a cross section of the cover skirt, and the groove radius is greater than the apex radius.

The hinge 22 allows a rotation of the cover 20 relative to the container body 10 about a rotation axis. Preferably, the vertical position of the rotation axis is, in an upright position of the container, between the apex 36 of the sealing portion 34 and an upper end of the peripheral body wall 16. Also preferably, the rotation axis of the hinge 22 is situated radially outside of the container body 10.

The cover 20 may be detachably connected to the container body 10, for example by means of a first connecting means 18 integral with the container body 10 and a second connecting means 24 integral with the hinge 22 provided on the cover 20.

Preferably the second connecting means 24 may be provided with at least one snapping hook and the first connecting means 18 may be provided with at least one recess for accommodating the snapping hook in order to connect the cover 20 at the container body 10. This may provide a snap connection of cover and container which can be made by simply assembling the second connecting means with the first connecting means.

In a further preferred embodiment the first connecting means may be integral with the container body. In this case the container may consist of only two separate parts container body and cover.

Preferably the hinge 22 may be a foil hinge. Foil hinges may be very reliable and may provide an exact rotation axis of the cover with respect to the container body. This may facilitate a very exact positioning of the cover during the closing movement which guarantees that the cover skirt with the sealing portion is not damaged during closing the cover.

The cover skirt 30 may be a separate piece of the cover 20.

In the following preferred embodiments of the invention are shown with respect to the figures.

FIG. 1 shows an airtight container 100 according to the invention. The container 100 consists of a container body 10 and a hinged cover 20. The container can be used, for example, to store medical goods such as test strips for blood glucose measurement. The container body 10 has an opening 12 which is surrounded by a peripheral body wall 16. The cover 20 can rotate around a hinge 22, preferably a foil hinge, for closing and opening of the container 100. A foil hinge is a flexible foil that is used as a hinge or a local reduction of material thickness defining a pivot axis. The foil is capable of being rotated or pivoted about an axis, i.e. a rotation axis, which axis extends parallel to a plane of extension of the foil.

A bead 14 surrounds the container body 10 and extends outwards from the peripheral body wall 16 and acts as a stop for the cover 20 in closed condition.

The protruding bead 14 surrounding the container peripheral body wall is interrupted, in a location facing the thumb tab 26 of the cover or cap 20. The outer peripheral cover wall is provided with a series of four protruding elements 41 (only three of them are visible in this perspective view). These protruding elements 41 are forming a cord between two points of junction of the circular outer peripheral cover. As a consequence of the presence of the protruding elements 41, the gap 50 between the outer peripheral cover wall 32 and the peripheral body wall 16 (when the cover is in the closed state) is locally reduced and a sideward translation of the cap (for example a translation from the thumb-tab 26 towards the hinge 22) is avoided.

The outer peripheral body wall is further provided with a protruding element 42 which also serves to locally reduce the gap between the outer peripheral cover wall 32 and the peripheral body wall 16.

The cover 20 is detachably connected to the container body 10 by means of a first connecting means 18 integral with the container body 10 and a second connecting means 24 integral with the hinge 22. The second connecting means 24 comprises two snapping hooks on opposite sides or one snapping hook on the total length of the hinge 22 or a combination of both which engage corresponding recesses at the first connecting means 18. To establish the connection it is just required to insert the second connecting means 24 into the first connecting means 18.

Figure 2:
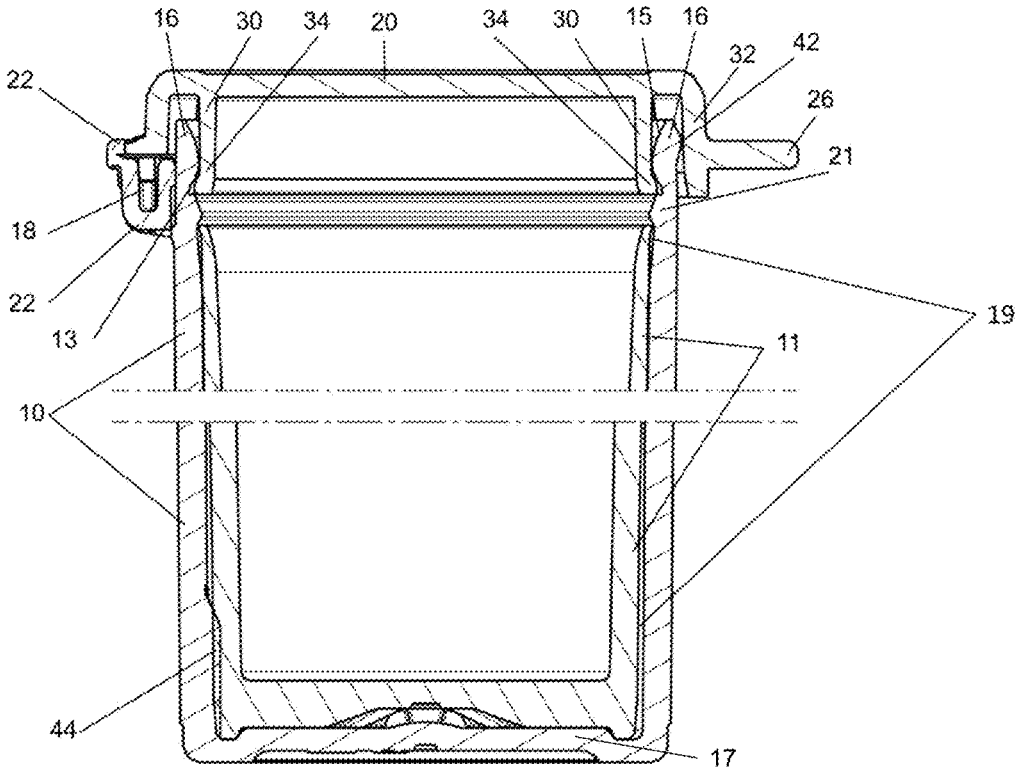
FIG. 2 shows the container 100 of the invention in longitudinal cross-sectional view in closed state.

FIG. 2 shows in a partial sectional view the container in closed condition. Particularly, it shows how the air tight sealing between container body 10 and cover 20 may be established. To this end the cover 20 comprises a cylindrical cover skirt 30 which provides the only seal and, at the same time, provides the only locking element for mechanically holding the cover 20 in place. The cover 20 also comprises a cylindrical outer peripheral cover wall 32 (which allows to protect the seal).

The cover skirt 30 is provided with a sealing portion 34 at an outer surface of the cover skirt 30. This sealing portion 34 cooperates with an inner peripheral body groove 13 on an inner surface of the peripheral body wall 16 of the container body 10 to both air tight seal the container and lock the cover 20 on the container body 10. In other words, the sealing portion 34 provides for the only seal and for the only locking element acting between the cover 20 and the container body 10.

For facilitating the closing of the cover 20 and to prevent any damages of the scaling portion 34 the peripheral body wall 16 is provided with a chamfer 15 at its upper inner edge. Further, the inner surface of the peripheral body wall 16 is provided very evenly and smoothly. For holding the cover 20 in closed condition there is no need to provide an additional projection or similar means which would engage with a corresponding protrusion on the outer surface of the peripheral body wall 16. In contrast, as an alternative to such mechanism, the present embodiment uses the sealing portion 34, which will be further specified below as comprising an apex 36, and a peripheral body groove 13, to provide both the seal and the locking element without the need of any additional interlocking mechanism.

In order to open the container the cover 20 comprises a thumb tab 26 which is arranged at the outer peripheral cover wall 32. By pressing the thumb tab 26 from below, the cover 20 is opened.

The clipping of the cover 20 at the container body 10 is combined with the sealing. The seal (apex 36 of sealing portion 34) engages the inner surface of the peripheral body wall 16, more specifically an inner peripheral groove 13 provided on the inner surface of the peripheral body wall 16. This configuration combined with at least one protruding element 41, 42 provides improved holding capabilities during depression tests without substantially impacting the opening forces which means that the improved design allows for a more reliable sealing without requiring the user to apply more force to open and/or close the container.

In one embodiment, the container body and the cover may be made in one piece. In another embodiment, the cover may be detachably connected to the container body.

Said cover may be produced independently and separately from said container body. This may allow producing the cover of a different material than the container body which may further increase air tightness or moisture tightness of the container due to a special material selection of both parts.

It has been found that combining materials from two different resin families results in a reduced sample-to-sample or batch-to-batch variability of the opening force.

A preferred material combination is HDPE for the container body, combined with PP for the cap. This material combination allowed to achieve at the same time a reduced moisture transmission rate (the container has increased barrier properties against moisture ingress) and a reduced variability of the opening force.

Further, it may be preferred that the cover skirt is a separate piece of the cover or that the cover skirt molded integral with the cover, but from a different material. Such embodiment may allow for tailoring the material of the cover skirt, in particular the apex of the sealing portion to be particularly suitable for its function as providing the seal and the locking element. At the same time, the remaining parts of the cover may use a material which can be tailored to its function such as rigidity, mechanical strength, air tightness, moisture tightness resistance to UV radiation etc.

FIG. 2 further shows an insert 11 which can be made of a special material within the container body 10. Preferably, the insert 11 is made of a desiccant entrained polymer, e.g. a polypropylene polymer containing a molecular sieve acting as desiccant, whereas the cover 20 and the container body 10 are preferably made of resins from a different polymer family, such as HDPE (high density polyethylene) for the container body and PP (polypropylene) for the cover.

In general, the insert may be made of a different material compared to the container body. By providing an insert within the container body the inner surface which contacts the stored goods can be made of an appropriate material which can be different to the material of the container body. For example, it can be favorable for medical applications to produce the insert of an inert material.

Also visible in FIG. 2 is a gap 19 between the outer surface of the desiccant insert and the inner surface of the container body. Such an air gap 19 improves the moisture uptake speed by the insert 11 made of a desiccant entrained polymer, which can even be improved if the fixation of the insert is of discontinuous nature. The insert can for example be force-fitted with series of locking ribs 44. In FIG. 2, only one of such force-fit rib 44 is visible, the others being not located in the section plan. The force-fit rib 44 located at the bottom of the container is issued from the peripheral body wall. Alternatively or in addition, force-fit ribs could also be provided on the insert side wall. At the upper section of the container, a projection 21 is provided on the inner surface of the peripheral body wall. The projection 21 is cooperating with the upper section of the insert, providing a form-fit assembly holding the insert assembled inside the container. The gap 19 between the outer surface of the insert and the inner surface may also be continued along the projection, with optionally local contact points to reduce risks of vibrations between the insert and the side walls of the container. In another preferred embodiment, the projection 21 may be locally interrupted such as to form an air passage towards the gap 19 between the outer surface of the desiccant insert and the inner surface of the container body. In other words, the projection 21 may be discontinuous.

Optionally, the insert 11 can also be provided with one or multiple through holes preferably provided on the bottom wall of the desiccant insert 11 or at the connection between the side wall and the bottom wall of the insert.

Figure 3:
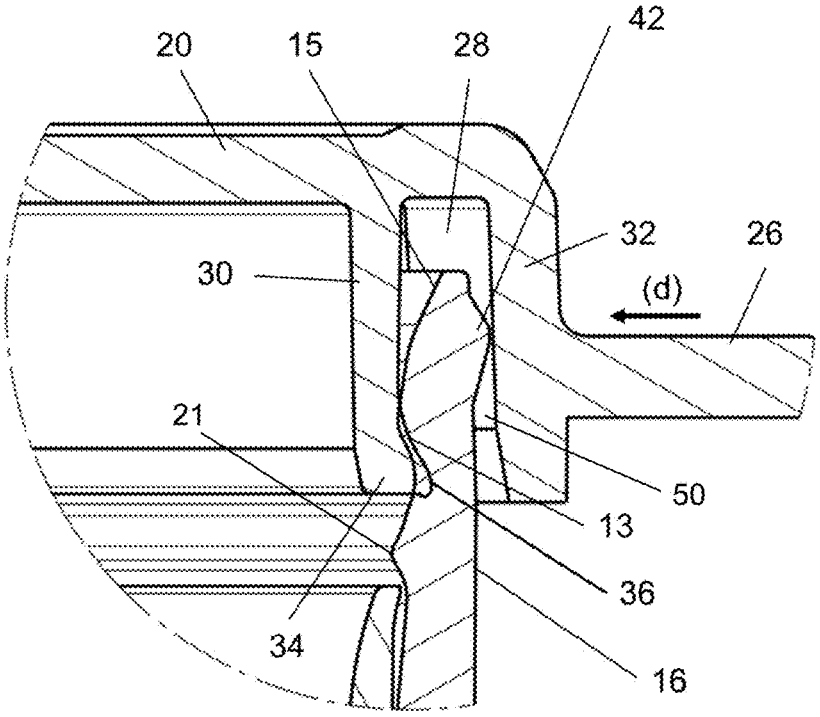
FIG. 3 shows an enlarged detail of the container 100 of the invention (upper right hand corner of the view of FIG. 2).

FIG. 3 shows details of the cover 20, particularly the elements of the sealing portion 34 at the cover skirt 30. The sealing portion 34 comprises an apex 36 which forms the actual contact line with the inner peripheral body groove 13.

In FIG. 3, the protruding element 42 located on the external surface of container's peripheral body wall 16 is visible, showing a close-to-contact condition with the inner surface of the peripheral cover wall. The gap between the protrusion 42 and the inner surface of the peripheral cover wall 16 is less than 0.1 mm. The cover 20 is held in a closed condition through the cooperation of the apex 36 cooperating with this peripheral body groove 13. The protruding element 42 does not form an interlocking with the inner surface of the peripheral cover wall 32. Its aim is to limit the possible movement of the cap 20 along direction (d) when a force is applied to open the cap.

The apex 36 is arranged at the outer edge of the cover skirt 30 and faces the outer peripheral cover wall 32. Between the outer peripheral cover wall 32 and the cover skirt 30 a clearance 28 is provided, which accommodates the peripheral body wall 16 in closed condition of the container.

The vertical distance of the apex 36 from a top wall of the cover 20 is smaller than the vertical extension of the outer peripheral cover wall. Therefore, the outer peripheral cover wall 32 protects the apex 36 from undesired contact with other elements, what may lead to damages of the apex 36 that forms the actual sealing line. This leads to an increased reliability of the container in view of air tightness.

Preferably, the apex is located close to the lower end of the covert skirt, for example the apex is located in the lowest third of the vertical extension of the cover skirt. Such the distance from the inner surface of the cover top wall to the apex is maximized to increase the flexibility of the cover skirt.

The thickness of the inner wall 30 is chosen to optimize on the one hand the compression force the apex 36 exerts to the inner peripheral body groove 13. On the other hand, as mentioned above, it has been found that it is favourable to avoid material accumulations at the sealing portion 34 since the sealing portion 34 is—time wise—the last portion of the injection mould that is filled. By reducing the wall thickness, material accumulations are avoided and subsequently material defects like sink marks are avoided which improves the geometry of the sealing portion 34, in particular the apex 36 and the air tightness of the container. The thickness T of the cover skirt 30 can be 0.4-1.2 mm, preferably about 1.2 mm.

For this reason the cover skirt 30 further comprises a chamfer 40 opposite to the scaling portion 34, hence, on the inner side of the lower end 35 of the cover skirt 30.

Figure 4:
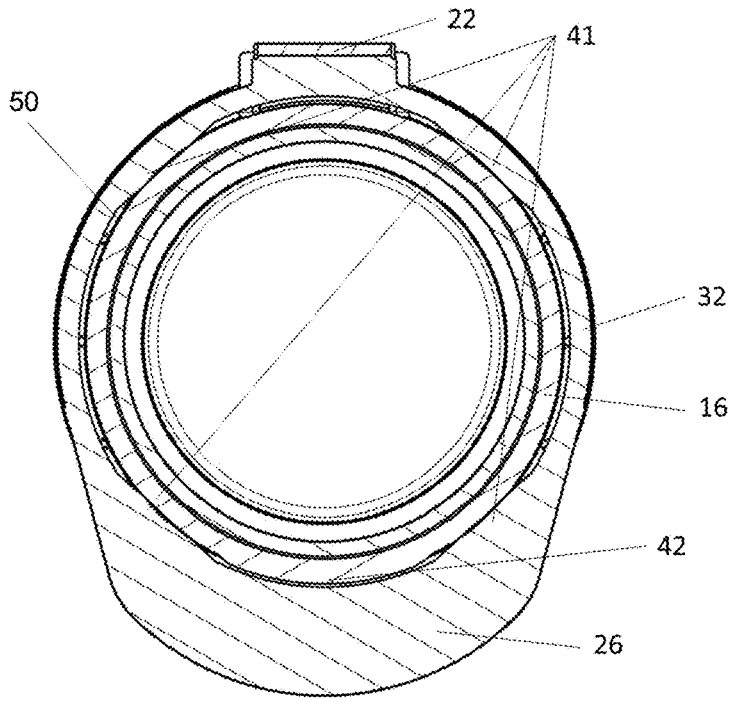
FIG. 4 shows a horizontal cross-sectional view of the container 100 of the invention in closed state.

FIG. 4 is a horizontal sectional view of the container in the closed condition, showing four protruding elements 41, angularly distributed around the circumference of the outer peripheral cover wall 32. An additional protruding element 42 located on the external surface of the peripheral body wall 16 is provided at the front side of the body wall. The surrounding gap between the peripheral body wall 16 and the outer peripheral cover wall 32 is locally reduced: the distance between the protruding elements 41, 42 and the outer peripheral cover wall 32 is less than 0.1 mm when measured at the closest point.

Figure 5:
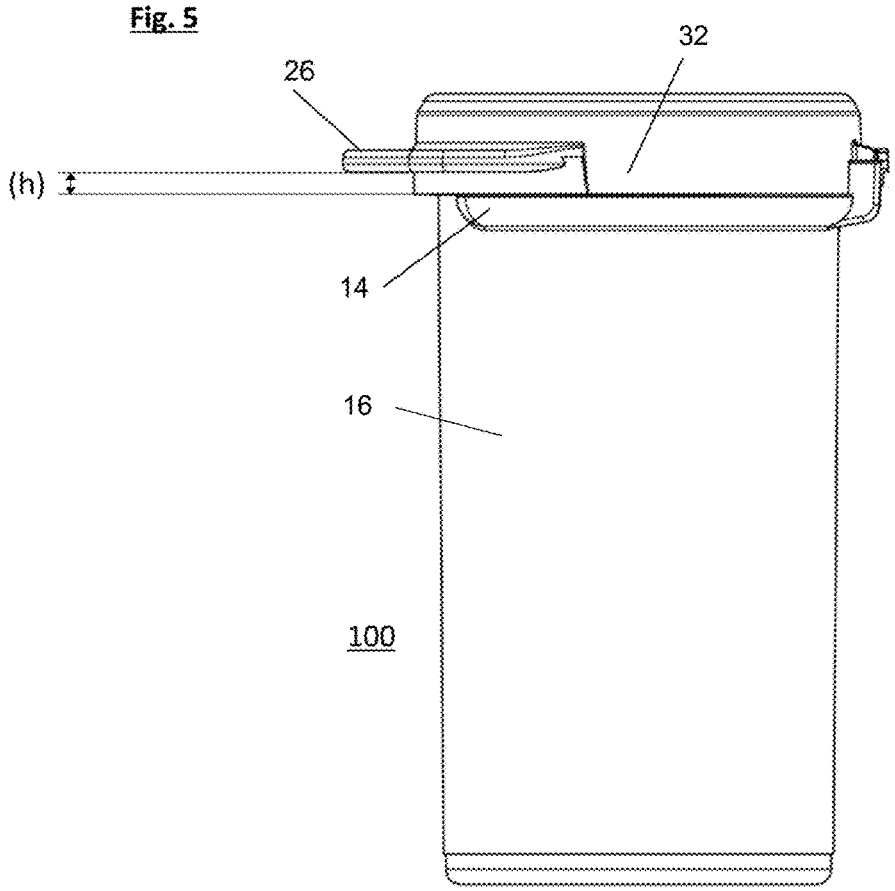
FIG. 5 shows a side view of the container 100 of the invention in closed state.

FIG. 5 is a side view of an embodiment of the container 100 where the thumb tab 26 is attached to the outer peripheral cover wall 16 at a height (h) located between the lower surface of the outer peripheral cover wall and the top wall of the cover. The lower surface of the thumb-tab 26 is not flush with the lower surface of the outer peripheral cover wall 16. Bead 14 is interrupted in the area below the location of the thumb tab 26 to provide an increased access to user's finger for opening the cap.

Preferably, the container body comprises an obstacle that stops the cover when said cover is closed, e. g. by abutting the cover against an obstacle which can have the form of a projection or similar. For example, when the cover is provided with an outer peripheral cover wall, the obstacle may be a bead extending outwardly from the wall of the container body. In the absence of an outer peripheral cover wall, the obstacle may be a stop on the upper end of the peripheral body wall of the container that interferes with the top wall of the cover.

To make the opening of the vial easier for the user, the protruding bead 14 surrounding the container peripheral body wall can be locally interrupted, in a location facing the thumb tab of the cap. Such an arrangement provides for a greater surface to be contacted by user's finger when opening the cover and avoids user's finger hurts the protruding bead 14 during cover's opening motion.

Finally, the thumb tab can be flush with the lower cover surface or attached to the outer peripheral cover wall at any height between the lower surface of the outer peripheral cover wall and the top wall of the cover.

In one embodiment, the lower surface of the thumb-tab is substantially aligned with the hinge bending point.

In one embodiment, the upper surface of the thumb-tab is not substantially flush with the attachment point of the hinge portion to the peripheral cover wall.

Figure 6:
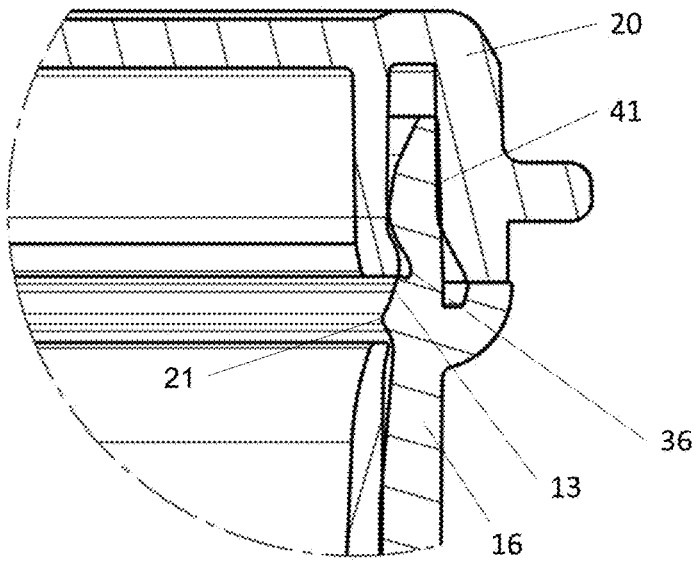
FIG. 6 shows an enlarged detail of the container 100 of the invention in cross-sectional view.
Figure 9:
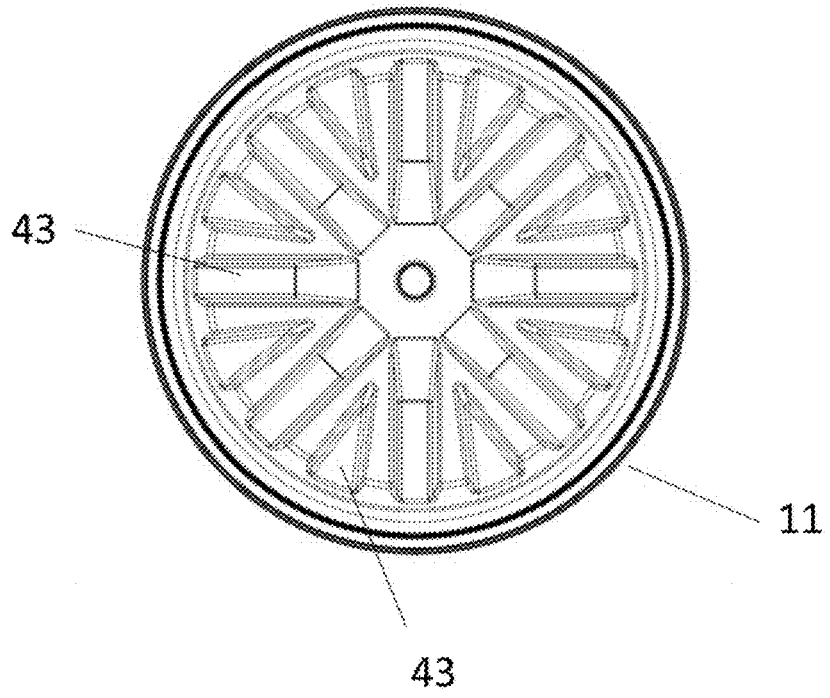
FIG. 9 shows the insert 11 in bottom view.

FIG. 6 is a vertical section cut through protruding element 41. In the embodiment of FIG. 9, the protruding element 41 is designed to provide a very small dimensional interference or contact with the peripheral body wall 16. The elements are represented in their design condition, so that the interferences or contact become visible. When closing the cover 20 over the peripheral body wall 16, the body wall and cover will deform and a contact is established between the protruding element 41 and the peripheral body wall 16. The protrusion 41 does not face nor interact with any other protrusion on the peripheral body wall 16.

The section view is provided at the point of maximal design interference. It shows that the interference/contact is carefully designed to remain significantly smaller than the interference/contact existing between apex 36 and peripheral body groove 13. This helps to avoid the risk of impacting the contact pressure along the only moisture tight seal of the container, which is formed between the apex 13 of the cover skirt and the inner peripheral groove 36.

Figure 7A:
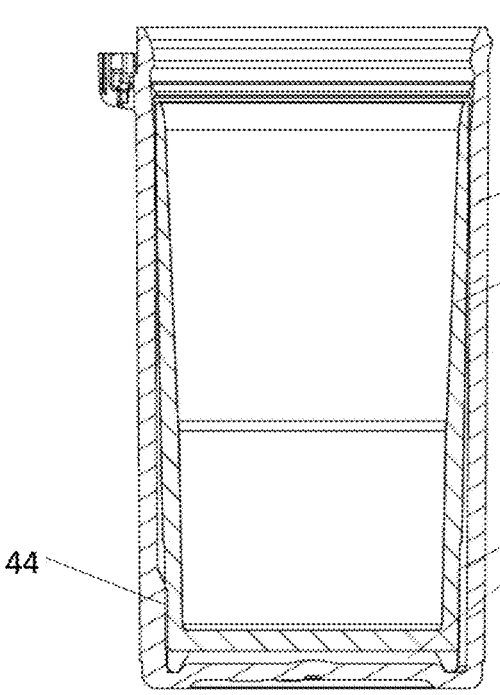
FIGS. 7A and 7B show cross sectional views of the container body 10 of the container 100 of the invention comprising an insert 11.

FIG. 7A shows a sectional view through the container body 10 and the insert 11 contained therein. The insert 11 is dimensioned in a way to allow air gaps 19 to be formed between the outer surface of the insert bottom and side walls and the inner surface of the container body bottom and side walls. Locking rib 44 assists in keeping the insert 11 fixed in the container body 10.

Figure 7B:
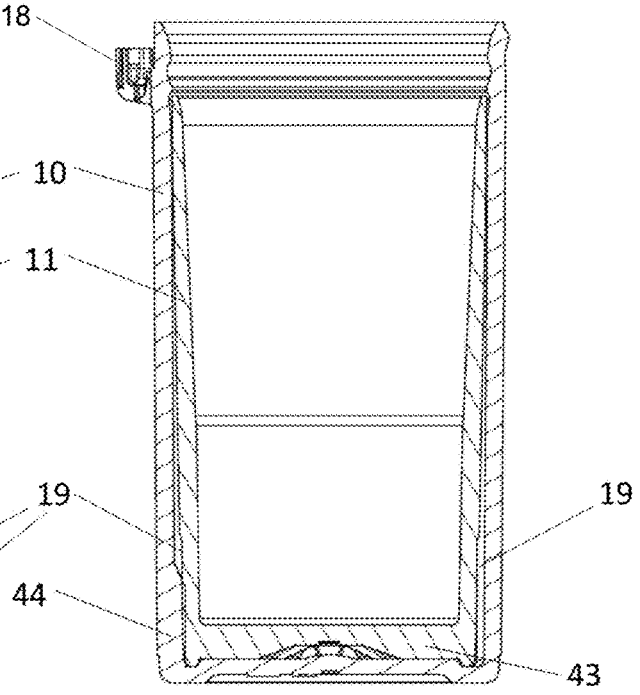

FIG. 7 B shows a sectional view similar to the one of FIG. 7A, however at a slightly different section plane, making insert ribs 43 visible.

Figure 8:
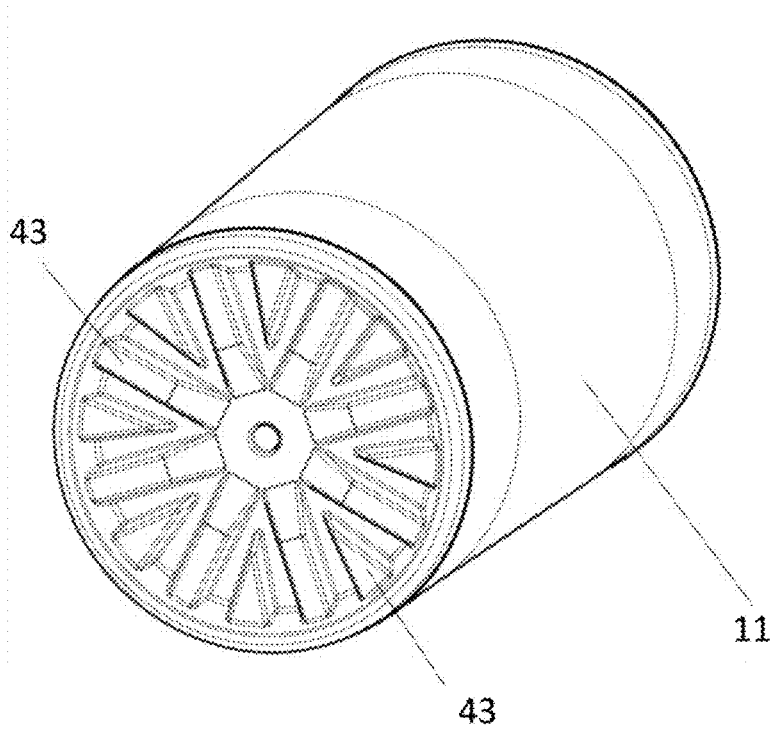
FIG. 8 shows the insert 11 in perspective bottom view.

FIGS. 8 and 9 show in top view and perspective view the ribbing system at the bottom of the insert 11 comprising insert ribs 43. The insert is preferably made from a desiccant entrained polymer. The ribbing system provides for additional weight (and therefore desiccant capacity) without creating excessive wall thicknesses. The higher the wall thickness, the longer the time needed for moisture to reach the desiccant particle located at the heart of the material thickness. Preferably, the insert obeys the relation V/S<0.8 mm, preferably V/S<0.7 mm, and most preferably V/S<0.65 mm, where S is the total exposed surface (the total surface of the insert, summing the ribs, the outer wall surface, the inner wall surface) and V is the volume of desiccant entrained plastic material (i.e., the volume of the insert).

In the specific example as shown in FIGS. 8 and 9:

V=4039 $mm^3$

S=6487.4 $mm^2$

V/S=0.62 (mm).

The resulting 'average' thickness of this embodiment is 1.24 mm.

Without provision of the ribs at the bottom, but otherwise the same geometry, the insert has an increased V/S:

V=4198 $mm^3$

S=6369.5 $mm^2$

V/S=0.66 (mm)—i.e an 'average' thickness of 1.32 mm.

Figure 10:
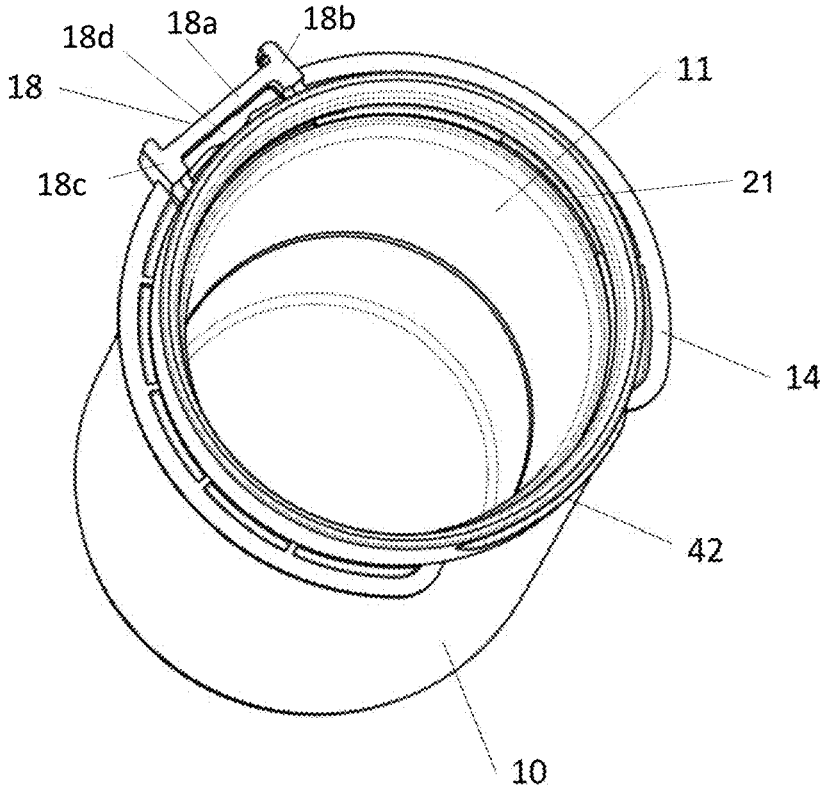
FIG. 10 shows the container body 10 provided with the insert 11 in perspective top view.

FIG. 10 shows the container body 10 in perspective top view, with the first connecting means 18, bead 14 and protruding element 42 being visible. Inside the container body 10, the insert is visible. The upper section of the insert is below a discontinuous projection 21 on the inner side of the container body wall 16.

Figure 11:
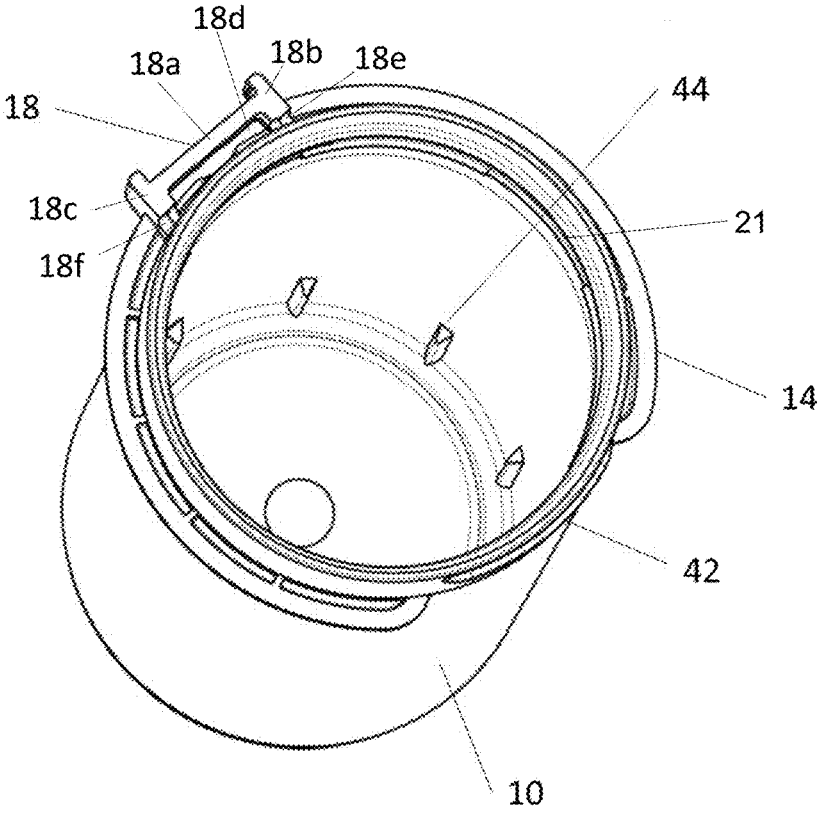
FIG. 11 shows the container body 10 of the embodiment of FIG. 10 without the insert, in perspective top view.

FIG. 11 shows the container body 10 of container 100 without the insert being present in perspective top view. In this view, the arrangement of the locking ribs 44 at the inside of the container body wall are visible. The discontinuous projection 21 is also shown. The first connecting means 18 of the container body 10 has a web 18*a* which is placed between two side parts 18*b* and 18*c*. Moreover, the connecting means 18 has an opening 18*d* between the web 18*a* and the outer surface of the peripheral body wall. In a preferred embodiment, notches (cut-outs) 18*e* and 18*f* are provided on the side parts 18*b* and 18*c*.

Figure 12A:
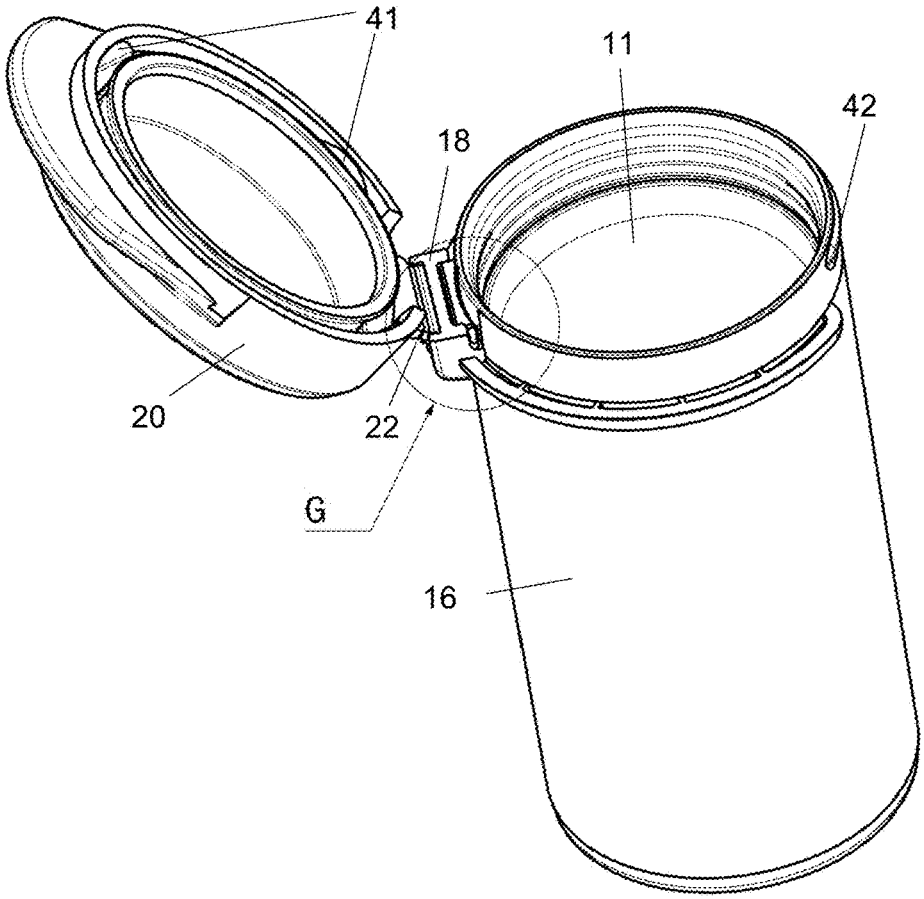
FIGS. 12A and 12B show respectively a perspective view of the container 100 of the invention in open state and an enlarged detail (G) of the hinge part of this container 100.
Figure 12B:
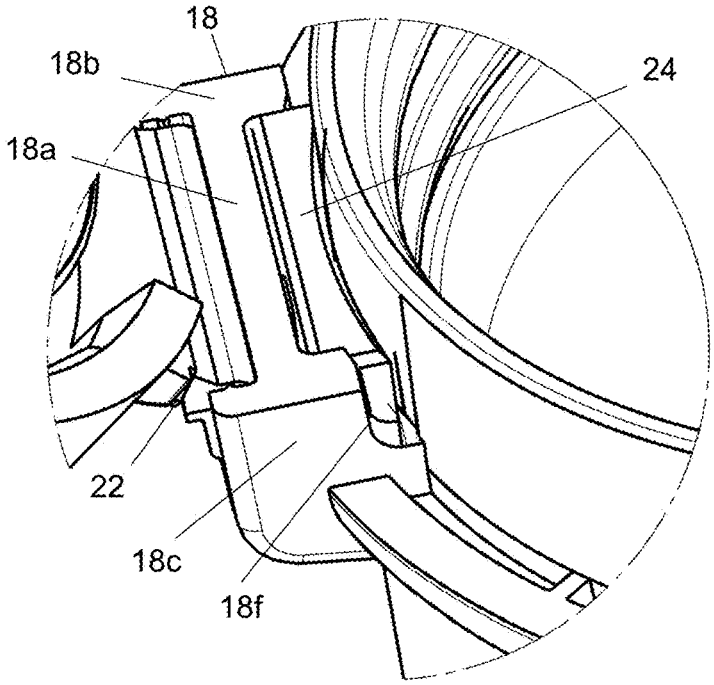

FIGS. 12A and 12B also show the hinge part where the cover 20 is detachably connected to the container body 10. The first connecting means 18 of the container body 10 has a web 18*a* which is placed between two side parts 18*b* and 18*c*. The hinge connecting means 18 is fixedly connected (intregrally moulded) in one piece with the container body 10. Moreover, the connecting means 18 has an opening 18*d* which extends between the side parts 18*b* and 18*c* for receiving the second connecting means 24. The second connecting means 24 is connected to the cover 20 and includes a film hinge.

In a preferred embodiment, notches (cut-outs) 18*e* and 18*f* are provided on the side parts 18*b* and 18*c*, where the side parts are connecting the outer surface of the peripheral body wall 16. These notches are advantageously reducing the section of the side parts at the point of junction with the peripheral side wall of the container, limiting the risk of sink marks being created on the opposed inner surface of the peripheral body wall 16. Preferably, the notches between the side parts and the outer surface of the peripheral body wall are located at a vertical position corresponding to the vertical position of the peripheral body groove 13 such as to increase the seal quality between the peripheral body groove 13 and the sealing portion 34 of the cover skirt 30.

EXAMPLE

The present invention will be illustrated in greater detail by the following specific example. It is understood that this example is given by way of illustration and is not meant to limit the disclosure or claims.

In order to evaluate the opening forces of containers according to the invention, a comparative test was carried out on two families of vials with identical geometry as regards the outside dimensions and the exchange surfaces, but with and without the series of protrusions. The vials basically correspond to the container 100 shown in FIG. 1. Both families of vials have a cover made of polypropylene (PP) and a container body made of high-density polyethylene (HDPE).

The first vial family was without the series of protrusions. The second vial family was with the series of protrusions 41, 42 according to the invention (as shown in FIG. 1).

Closed vials were fixed on an automated force tester (Chatillon TCD200). The thumb tab 26 was submitted to a vertical force exerted by a disc that displaces upwardly (i.e. in the opening direction of the vial). The vertical force was applied to the thumb tab at a point located at 4 mm from the end of the tab under a traction speed of 150 mm/min. The vertical force was recorded until the opening has been achieved. This test aimed at measuring the opening forces required by a user to open the cover on purpose. The corresponding opening forces (N) were recorded in Table 1 below:

TABLE 1

| | First family: vials without the series of protrusions | Second family: vials according to the invention with the series of protrusions |
|---|---|---|
| Measured opening force (N) | 16.5 | 21.9 |
| | 16.9 | 22.1 |
| | 16.5 | 22.1 |
| | 16.9 | 22.3 |
| | 16.9 | 21.8 |
| | 16.9 | 21.9 |
| | 17.3 | 22.9 |
| | 16.9 | 22.2 |
| | 16 | 22.3 |
| | 15.6 | 22.7 |
| Mean | 16.7 N | 22.2 N |
| SD/Mean | 3% | 1.6% |

Accordingly, the present invention allows an improved holding of the cap and a reduced variability of the opening force.

As has been demonstrated and described above, the present invention provides an improved container which is in particular useful for storing loose products, in particular such products that are sensitive towards air and/or moisture.

In this context, the protrusions provided on the peripheral body wall of the container and/or on the outer peripheral wall of the cover assist in making closing of the cover easier and more reliable by acting as guide elements. In addition, the said protrusions assist in maintaining the seal established between the body and cover of the container in that they effectively make deforming of the container body and cover more difficult and unlikely.

Also in this context, the special shape and geometry of the insert in combination with the geometry of the container body is advantageous in that it offers a high surface area while at the same time maintaining mechanical stability and accessibility for air and/or moisture.

While the present invention has been illustrated with particular reference to a "sealing line" type seal formed by cover and container body, it is also applicable with other seal types known in the art, like e.g. surface seals.

While the figures show embodiments with four protruding elements provided in the cover and one protruding element on the peripheral body wall, other arrangements are possible as well, including more or less than four protrusions in the cover and more or less protrusions on the peripheral body wall.

Also, the exact geometry of the protrusions 41 and 42 is not to be understood to be limited to the geometry shown in the figures.

As previously stated, detailed embodiments of the present invention are disclosed herein; however, it is to be understood that the disclosed embodiments are merely exemplary of the invention that may be embodied in various forms. It will be appreciated that many modifications and other variations that will be appreciated by those skilled in the art are within the intended scope of this invention as claimed below without departing from the teachings, spirit and intended scope of the invention.

The invention claimed is:

1. A container comprising a) a container body comprising a peripheral body wall;

b) a cover comprising an outer peripheral cover wall and a cover skirt;

c) a hinge connecting the container body and the cover; and d) a protruding element provided on an outer side of the peripheral body wall of the container or on an inner side of the outer peripheral cover wall, wherein the protruding element provides a local reduction of a surrounding gap between the peripheral body wall of the container and the outer peripheral cover wall when the cover is in a closed state, wherein the protruding element is not part of a catch and latch mechanism, wherein the peripheral body wall comprises an inner peripheral body groove and the cover skirt comprises an outwardly facing sealing portion with an apex that seals against the inner peripheral body groove when the cover is in a closed condition, and wherein the sealing portion of the cover skirt and the inner peripheral body groove provide the only locking element between the cover and the container body when the container is in the closed condition.

2. The container of claim 1, wherein the apex of the cover skirt and the inner peripheral body groove form a seal of a sealing line type when the container is in the closed condition.

3. The container of claim 1, wherein the apex of the cover skirt and the inner peripheral body groove provide the only seal between the cover and the container body when the container is in the closed condition.

4. The container of claim 1, wherein the protruding element is located on the outer peripheral cover wall and at least one additional protruding element is located on the peripheral body wall of the container.

5. The container of claim 1, wherein the protruding element does not form a locking element.

6. The container of claim 1 comprising the protruding element and a second protruding element, wherein each protruding element is provided on one among the outer side of the peripheral body wall of the container and the inner side of the outer peripheral cover wall.

7. The container of claim 6, wherein the protruding elements are angularly spaced from each other when the cover is in a closed state.

8. The container of claim 1, wherein the protruding element is provided on one among the outer side of the peripheral body wall of the container and the inner side of the outer peripheral cover wall without facing, interacting with or contacting another protruding element of the other among the outer side of the peripheral body wall of the container and the inner side of the outer peripheral cover wall, when the cover is in a closed state.

9. The container of claim 1, comprising the protruding element and at least two additional protruding elements, wherein each protruding element is provided on one among the outer side of the peripheral body wall of the container and the inner side of the outer peripheral cover wall.

10. The container of claim 9, wherein the protruding elements are angularly spaced from each other when the cover is in a closed state.

11. The container of claim 1, wherein a vertical distance of the apex of the sealing portion from a top wall of the cover is smaller than a vertical extension of the outer peripheral cover wall.

12. The container of claim 1, wherein the apex of the sealing portion is located in a lowest third of the vertical extension of the cover skirt.

13. The container of claim 1, wherein the hinge connecting the container body and the cover is a foil hinge.

14. The container of claim 1, wherein the cover is made of a different material than the container body.

15. The container of claim 1, wherein the cover skirt is made of a different material than remaining parts of the cover.

16. The container of claim 1, further comprising a desiccant insert in the container body.

17. The container of claim 16, wherein an air gap is provided between an outer surface of the desiccant insert and an inner surface of the container body.

18. The container of claim 1, wherein the protruding element is not part of a catch and latch mechanism for mechanically holding the cover in a closed state.

19. The container of claim 1, wherein the protruding element does not form a recess of a catch and latch mechanism and does not interact with a recess of a catch and latch mechanism.

* * * * *